US005996285A

United States Patent [19]

Guillemet et al.

[11] Patent Number: 5,996,285

[45] Date of Patent: Dec. 7, 1999

[54] IN-LINE WINDOW STRUCTURE FOR TRANSPORT VEHICLE

[75] Inventors: Guy Guillemet; Sylvain Gagnon, both of Terrebonne, Canada

[73] Assignee: Transit Pyramid Products Ltd., Quebec, Canada

[21] Appl. No.: 09/096,472

[22] Filed: Jun. 12, 1998

[51] Int. Cl.[6] ..... E05D 15/10

[52] U.S. Cl. ..... 49/213; 49/380; 49/408

[58] Field of Search ..... 49/127–130, 209, 49/211–213, 380, 449, 450; 52/204.51

[56] References Cited

U.S. PATENT DOCUMENTS 3,694,959 10/1972 Gartner ..... 49/128
5,285,596 2/1994 Kinsey ..... 49/450 X
5,542,214 8/1996 Buening ..... 49/380
5,799,444 9/1998 Freimark et al. ..... 49/209 X

*Primary Examiner*—Daniel P. Stodola
*Assistant Examiner*—Hugh B. Thompson
*Attorney, Agent, or Firm*—Swabey Ogilvy Renault; Guy J. Houle

[57] ABSTRACT

An in-line window structure for a transport vehicle is comprised of a rectangular frame in which a fixed pane is immovably secured. A displaceable pane is positionable adjacent the fixed pane in a common plane therewith. A lock interconnects sash members of the fixed and displaceable panes when positioned in a common plane. Guide tracks are provided by an elongated straight track section extending behind the fixed pane, and commuting track sections for guided displacement of the displaceable pane from the common plane to the straight track section and behind the fixed pane and substantially in alignment therewith whereby to create an opening in the rectangular frame to one side of the fixed pane. The lock is incorporated in a handle which, when squeezed, automatically retracts a latch bolt.

8 Claims, 3 Drawing Sheets

IN-LINE WINDOW STRUCTURE FOR TRANSPORT VEHICLE

TECHNICAL FIELD

The present invention relates to a window structure for transport vehicles, such as buses, ships, locomotives, underground vehicles, etc., wherein a displaceable pane may be positioned in-line beside a fixed pane and displaced to create an opening through the frame of the window structure without removing the displaceable pane from the window frame. When positioned in-line the panes lie in the same plane and provide improved air flow thereover when the vehicle is in movement. As well, the in-line panes protect the seals in the sliding tracks and provide noise reduction as compared with offset panes.

BACKGROUND ART

In transport vehicles such as buses which are used for transporting people, many of the window structures therein comprise single panes which are secured in window frames. It is a requirement, however, that some of these window structures provide an evacuation passage for the passengers when in an emergency situation and therefore the window pane must be secured in a frame structure which will cause the pane to release itself from the frame by applying pressure against the pane. Such window structures are also commonly provided in ships where the pane cannot be opened to prevent water from infiltrating into the cabins but may be released by applying an outward pressure on the pane under emergency situations. A major disadvantage of such window structures is that they do not make it readily apparent that the window pane can be removed by applying pressure thereon from inside the vehicle. Also, the securing structure of the panes may not always cause the pane to be released by pressure due to malfunctions usually resulting from rust formation or the infiltration of foreign matter into the release mechanism. Another disadvantage of such window panes is that they cannot be forced out by children nor do children have the intelligence of realizing, particularly under a crisis situation, that a window pane can be opened by applying pressure thereon.

There is also a need to provide, in combination with such panes, a window lock which is easy and obvious to operate in order to open a window pane quickly under a crisis situation. There is also a need to provide a reliable window pane opening technique which is easy to assemble and to operate and which provides through-passage without destruction to the window pane or any part of the window frame structure.

A major inconvenience with offset sliding window panes provided on moving vehicles is that they cause friction noise with air flow when the vehicle is in motion. They also accumulate debris in the outer exposed track and cavities due to a vacuum effect caused by the air turbulence. The dirt infiltration also affects the sliding displacement of the panes in their respective track and cause wear of the nylon glide bushings. They also accumulate road salt deposits in winter months which lead to corrosion. This also makes it more difficult to remove the panes for cleaning.

Further when a single pane breaks it is often necessary to remove the frame to effectuate the glass pane replacement.

SUMMARY OF INVENTION

It is therefore a feature of the present invention to provide an in-line window structure for a transport vehicle and which overcomes the above-mentioned disadvantages of the prior art.

Another feature of the present invention is to provide an in-line window structure wherein a displaceable pane which is disposed in-line with a fixed pane may be quickly disconnected and displaced from its in-line position to a position behind the fixed pane while providing an exit through the window frame.

Another feature of the present invention is to provide an in-line window structure wherein a displaceable pane is interlocked with a fixed pane by a simple lock actuating handle structure which automatically opens when the handle is displaced and which provides for the displaceable pane to be arrested at different partially opened positions to admit air.

Another feature of the present invention is to provide an in-line window structure provided with a displaceable pane which may be quickly displaced from an in-line position to a position behind a fixed pane and without disconnecting the displaceable pane from the window frame and which provides for the displaceable pane to be easily removed from the frame or repositioned to its in-line position quickly and efficiently.

Another feature of the present invention is to provide a sliding in-line window structure mounted in a rectangular frame which may be secured horizontally or vertically on a vehicle.

Another feature of the present invention is to provide a sliding in-line window structure wherein the panes are easily removed for repair, require little maintenance and which are easy to dismantle.

According to the above features, from a broad aspect, the present invention provides an in-line window structure for a transport vehicle, said window structure comprising a rectangular frame, a fixed pane having a sash frame immovably secured in said rectangular frame, a displaceable pane also having a sash frame securable to a side of said fixed pane in a common plane therewith, said displaceable pane having a handle secured to a vertical sash member intended to be positioned adjacent a vertical sash member of said fixed pane, lock means for interconnecting said adjacent vertical sash members when positioned adjacent one another in said common plane, said sash frame of said displaceable pane having a top and bottom horizontal sash member, said top and bottom horizontal sash members having follower elements extending into oppositely aligned guide tracks provided in a top and bottom frame member of said rectangular frame, said guide tracks having an elongated straight track section thereof extending behind said fixed pane and parallel thereto and commuting track sections for guided displacement of said displaceable pane from said common plane to said straight track section and behind said fixed pane and substantially in alignment therewith whereby to create an opening in said rectangular frame to one side of said fixed pane. The fixed and displaceable panes are thermo-panes having two spaced-apart glass sheets, with an outer one of the glass sheets of the displaceable pane having a vertical projecting section extending beyond an inner one of the glass sheets to permit the displaceable pane to hinge inwardly into the rectangular frame on the pin elements adjacent opposed ends of the vertical sash member disposed in the vertical retention channel. When the panes are disposed in-line, an outer one of the glass sheet is closely spaced to an outer peripheral edge of the frame to provide a flush outer surface with the frame.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
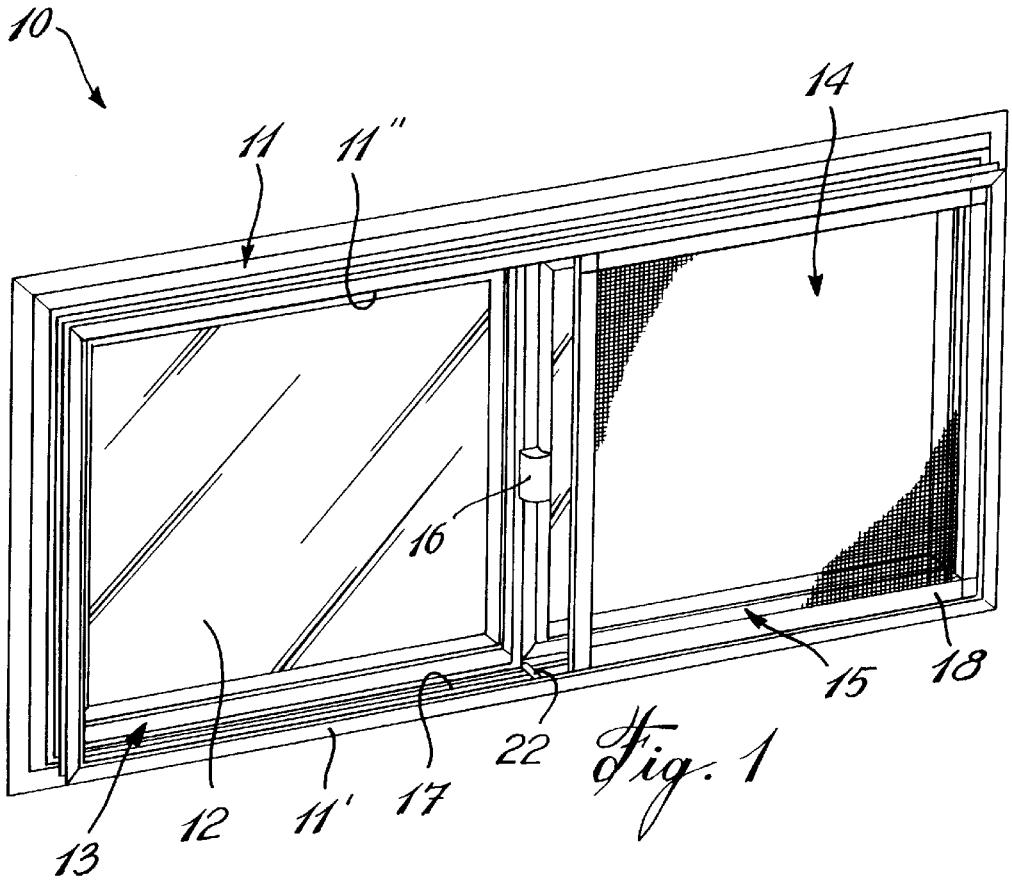
FIG. 1 is a perspective view of the in-line window structure of the present invention with the displaceable pane secured in-line with a fixed pane.
Figure 2:
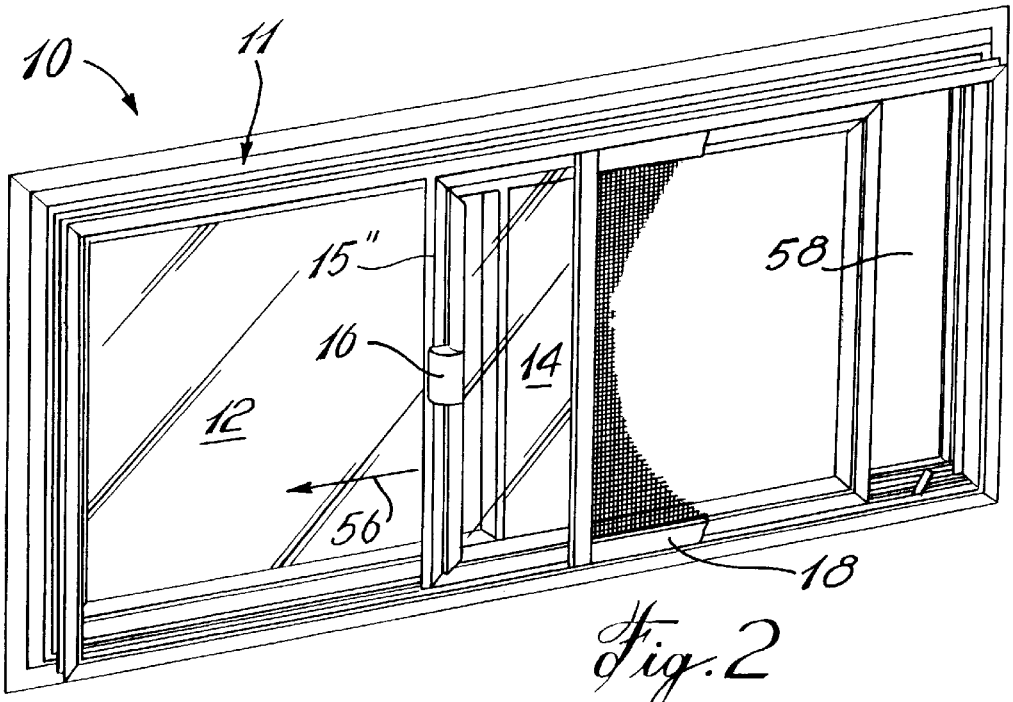
FIG. 2 is a perspective view similar to FIG. 1 but showing the displaceable pane disposed out of its in-line position.

Referring now to the drawings, and more particularly to FIGS. 1 and 2, there is shown generally at 10 the in-line window structure of the present invention for use in a transport vehicle (not shown) such as a bus, ship, train, etc. The in-line window structure 10 is comprised of a rectangular frame 11 in which a fixed pane 12 having a sash frame 13 is removably secured. A displaceable pane 14 also provided with a sash frame 15 is retained within the rectangular frame 11 and securable to a side of the fixed pane 12 in a common plane therewith, as shown in FIG. 1. The displaceable pane 14 is provided with a handle 16 having a connection to a lock pin, as will be described later with reference to FIG. 4.

Opposed guide tracks 17 are secured in both the lower and upper horizontal rectangular frame members 11' and 11" to provide guided displacement of the displaceable pane 14. A frame with a screen 18 may be disposed rearwardly of the displaceable pane while permitting access to the handle 16 and in non-interference with the guide tracks 17.

As shown in FIG. 2, the displaceable pane 14 may be displaced in a guided manner between opposed guide tracks 17 to a position spaced behind the fixed pane 12 and in substantial alignment therewith, as will be described later. In the upper guide track 17' there is provided one or more holes to secure the displaceable pane 14 at a predetermined open position by receiving the lock pins 19 therein. Hole 36 is provided in the front guide track 17' to lock the displaceable pane 14 in-line with the fixed pane 12.

Figure 3:
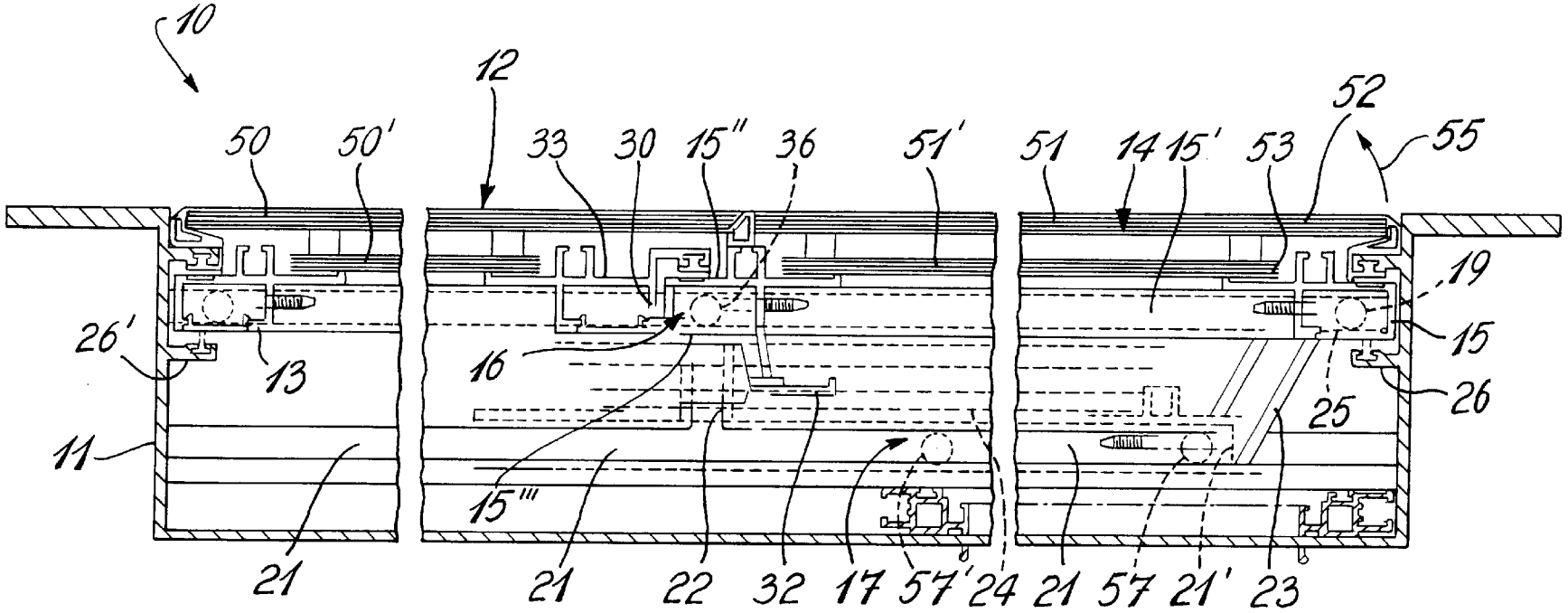
FIG. 3 is a horizontal cross-section view of the in-line window structure of the present invention.
Figure 4:
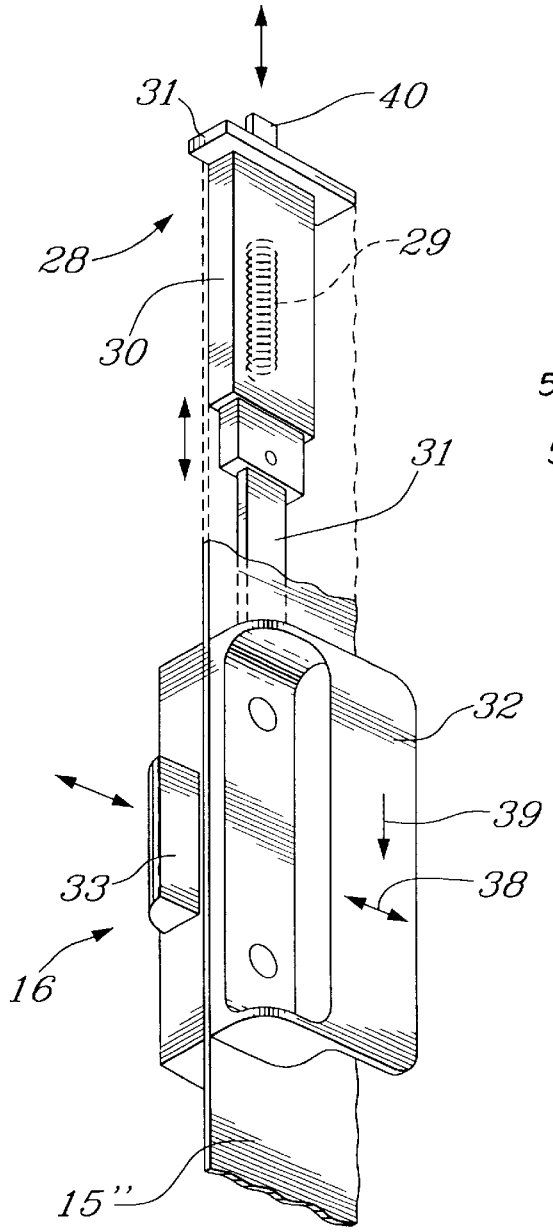
FIG. 4 is an exploded perspective view showing the construction of the lock bolt and handle assembly.
Figure 5:
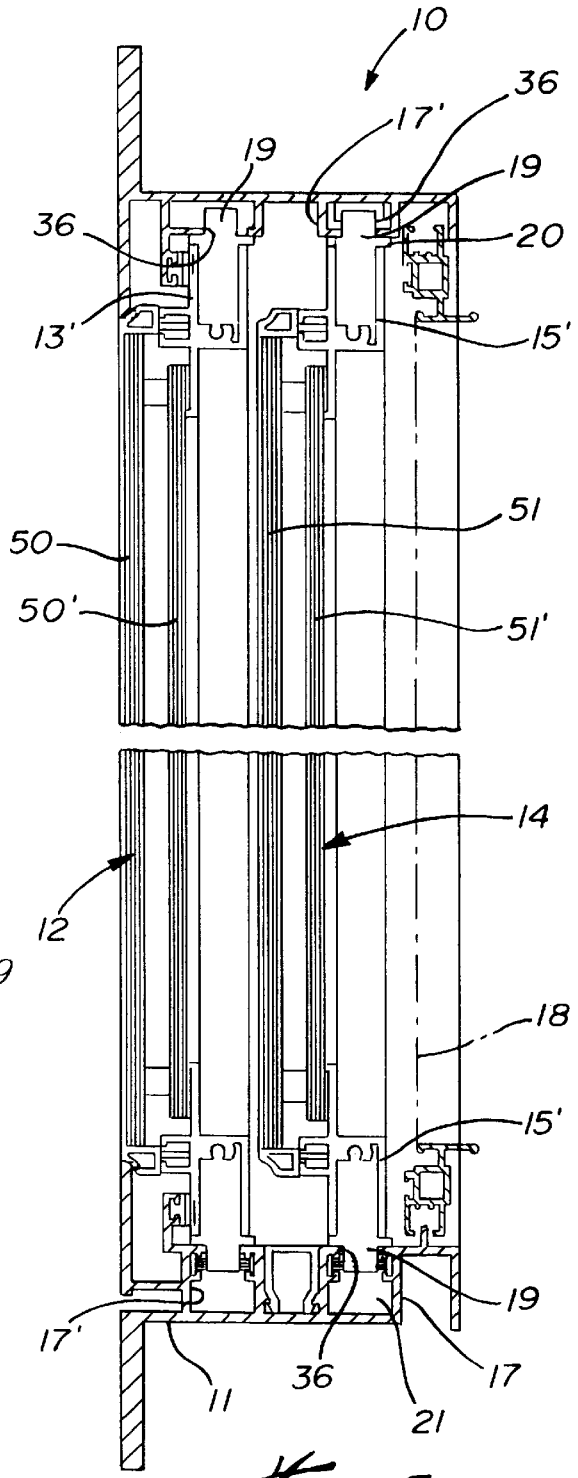
FIG. 5 is a vertical section view of the in-line window structure of the present invention illustrating the displaceable pane retracted from its in-line position.

Referring now additionally to FIGS. 3 and 4, there will be described in more detail the construction of the in-line window structure 10 of the present invention. The top horizontal sash frame members 13', namely the top horizontal sash member of the fixed pane 12 is also provided with two retractable lock pin elements 19 (well known in the art) which extend outwardly of the outer wall 20 of the sash frame, as shown in FIG. 5, wherein to be retained captive in aligned holes 36 provided in the top guide track 17'. As better shown in FIG. 3, the lock pin elements 19 are disposed adjacent a respective end of the horizontal sash members 15' and these pin elements are spring loaded whereby to permit their retraction should it be necessary to remove the fixed pane 12 from the rectangular frame 11.

As can be seen from FIG. 3, the opposed guide tracks 17 each have an elongated straight track section 21 which extends behind the fixed pane 12 and parallel thereto. Commuting track sections herein comprised of a first straight track section 22 and an angulated straight track section 23 provide for the displaceable pane 14 to be moved from its in-line position, as shown in FIG. 3, to a position behind the fixed pane section 12, as shown by the phantom lines 24. The straight track section 22 is disposed in transverse alignment between the elongated straight track section 21 and the lock pin element 19' adjacent the vertical sash member 15" of the displaceable pane 14. The angulated straight track section 23 interconnects a free end 21' of the elongated straight track section 21 to a position leading into a straight channel end section 25 which extends into a vertical retention channel 26 of the rectangular frame 11 and disposed in a common plane with the sash frame 13 of the fixed pane 12. The fixed pane is also retained in a vertical retention channel 26' provided in the rectangular frame 11.

With further reference to FIG. 4 there will now be described the construction of the handle assembly 16. It consists of a lock bolt assembly 28, shown in FIG. 4, which is comprised of a lock pin body 40 which is spring loaded by helical spring 29 in retaining housing 30. The pin 40 projects out of the end wall 31 of the housing which is mounted in a top portion of the vertical sash member 15", as clearly illustrated in FIG. 3, when the lock pin body 40 is retained captive in the hole 36 in the top forward track. The lock pin 40 is connected to an actuating rod 31 which is pulled upward by the spring 29. A handle 31 is connected to the rod 31 which extends in the vertical sash member 15". By pushing down on the handle 31 the lock pin is retracted and the displaceable sash can be pulled back by the handle. A follower spring biased pin is mounted in the opposed vertical sash member 15'.

As seen in FIG. 4, the handle 32 is further provided with a lock bolt 33 which is engageable within a lock bolt receiving aperture (not shown) provided in the frame 11 next to the fixed pane 12 whereby when the displaceable pane is in-line with the fixed pane, both panes can be locked together in an in-line plane. The manner in which the handle is secured to the vertical sash member 15" which is center most of the in-line panes is obvious to a person skilled in the art. Accordingly, when the handle is moved in the directions of arrows 38 the lock bolt is engaged or retracted whereby to connect or disconnect to the fixed pane. When the handle is pulled downwards in the direction of arrows 39, the displaceable pane is disconnected from the in-line track with the fixed pane and may be reconnected at predetermined positions, such as in holes 57 and 57' along the rear parallel track 21 whereby to create a fixed partial window opening. It is also to be noted that the handle will permit the removal of the displaceable pane from the window frame. As well, the retractable lock pin elements 19 will provide for the removal of the fixed pane from the forward track of the window frame to permit the panes to be washed or repaired.

As shown in FIGS. 3 and 5, the fixed and displaceable panes 12 and 14 are thermo-panes having two spaced apart glass sheets 50 and 50' and 51 and 51', respectively. The outer glass sheet 51 of the displaceable pane 14 has a vertical projecting section 52 which extends beyond the vertical edge 53 of the inner glass sheet 51' to permit the displaceable pane 14 to hinge inwardly into the rectangular frame 11 on the lock pin element 19 located in the straight track section 22 at the end of the vertical sash member 15'". The projection section 52 of the outer glass sheet 51 will then swing out in the direction of arrow 55.

It can be appreciated that with the combination lock and handle structure as herein described the displaceable pane can be quickly unlocked from its in-line position with the fixed pane and displaced to a retracted position to provide access to the opening 58 (see FIG. 2) in the rectangular frame 11. If a screen frame 18 is in place there behind, it can also be quickly slid aside to provide access to the opening 58. Accordingly, there is provided an in-line window pane which can also be partly opened to provide for the admission of fresh air into the transport vehicle or to provide access to the exterior of the vehicle through an opening created in the window pane without damaging the window pane.

It should also be appreciated that with the in-line window structure as herein described, a smooth outer airflow will be displaced against the panes during movement of the vehicle and there are virtually no exposed areas wherein dust or salt spray can be accumulated to cause the disadvantages above-referred to. Furthermore, the frame may be mounted horizontally as shown in FIGS. 1 and 2 or vertically. In the vertical position, a guillotine-type pane assembly is provided and preferably the displaceable pane is located uppermost. To position the displaceable pane in-line, it is merely necessary to push it upward in the track and it will locate itself in-line with the bottom fixed pane. To disconnect it, the handle is again operated as above-described to unlatch its connection to the fixed pane and to retract the lock pin from its engagement within the forward track. The displaceable pane is then retracted inwards and downwards.

It is within the ambit of the present invention to cover any obvious modifications of the preferred embodiment described herein. As such, those skilled in the art will appreciate that the conception, upon which this disclosure is based, may readily be recognized as a basis for the designing of other structures and methods for carrying out the several purposes of the present invention. It is important, therefore, that the claims be regarded as including such equivalent constructions insofar as they do not depart from the spirit and scope of the present invention.

We claim:

1. An in-line window structure for a transport vehicle, said window structure comprising a rectangular frame, a fixed pane having a sash frame immovably secured in said rectangular frame, a displaceable pane also having a sash frame securable to a side of said fixed pane in a common plane therewith, said fixed and displaceable panes being thermopanes having two spaced-apart glass sheets, an outer one of said glass sheets being closely spaced to an outer peripheral edge of said frame when said panes are disposed in-line in said common plane to provide a flush outer surface with said frame, said displaceable pane having a handle secured to a vertical sash member intended to be positioned adjacent a vertical sash member of said fixed pane, lock means for interconnecting said adjacent vertical sash members when positioned adjacent one another in said common plane, said sash frame of said displaceable pane having a top and bottom horizontal sash member, said top and bottom horizontal sash members having follower elements extending into oppositely aligned guide tracks provided in a top and bottom frame member of said rectangular frame, said guide tracks having an elongated straight track section thereof extending behind said fixed pane and parallel thereto and a commuting track section for guided displacement of said displaceable pane from said common plane to said straight track section and behind said fixed pane and substantially in alignment therewith whereby to create an opening in said rectangular frame to one side of said fixed pane, said commuting track section being comprised by a first straight track section and a second angulated straight track section, said first straight track section being disposed in transverse alignment between said elongated straight track section and said follower elements which are adjacent said vertical sash member, the sash member having said handle connected thereto, and said second angulated straight track section extending from a free end of said elongated straight track section behind said displaceable pane and terminating into a straight channel end section, one of the follower elements extending into a vertical retention channel of said rectangular frame disposed in a common plane with said sash frame of said fixed pane, said outer one of said glass sheets of said displaceable pane having a vertical projecting section extending beyond an inner one of said glass sheets and a vertical rear sash member of said displaceable pane to permit said displaceable pane to be retracted inwardly into said rectangular frame on one of the follower elements.

2. An in-line window structure as claimed in claim 1 wherein said lock means comprises a lock pin body retained captive in said vertical sash member of said displaceable pane intended to be positioned adjacent said vertical sash member of said fixed pane for engagement in a hole provided in a guide track section adjacent said fixed pane, said lock pin (means) body being spring-biased outwardly of said sash.

3. An in-line window structure as claimed in claim 2 wherein said (spring means is constituted) lock pin body is spring-biased by a helical spring(s) retained captive and in compression in an inner vertical wall section of said vertical sash member of said displaceable pane and biases said handle vertically upwards.

4. An in-line window structure as claimed in claim 1 wherein said follower elements are pin elements disposed adjacent a respective end of said top and bottom horizontal sash members of said displaceable pane and projecting into said guide tracks.

5. An in-line window structure as claimed in claim 4 wherein some of said pin elements are retractable spring-biased pins to permit the installation and removal of said displaceable pane from said guide tracks.

6. An in-line window structure as claimed in claim 1 wherein said transport vehicle is a bus, train or water vessel for transporting people.

7. An in-line window structure as claimed in claim 6 wherein said in-line window structure is a safety window for the evacuation of people from said transport vehicle.

8. An in-line window structure as claimed in claim 1 wherein said frame is mounted in a vertical fashion with said horizontal sash members extending vertically.

* * * * *